US005514025A

United States Patent [19]

Hasegawa et al.

[11] Patent Number: 5,514,025

[45] Date of Patent: May 7, 1996

[54] APPARATUS AND METHOD FOR CHAMFERING THE PERIPHERAL EDGE OF A WAFER TO SPECULAR FINISH

[75] Inventors: Fumihiko Hasegawa, Urawa; Masayuki Yamada, Shirakawa, both of Japan

[73] Assignee: Shin-Etsu Handotai Co. Ltd., Tokyo, Japan

[21] Appl. No.: 122,941

[22] Filed: Sep. 20, 1993

Related U.S. Application Data

[63] Continuation of Ser. No. 888,097, May 26, 1992, abandoned.

[30] Foreign Application Priority Data

May 24, 1991 [JP] Japan ..... 3-148231

[51] Int. Cl.[6] ..... B24B 9/06

[52] U.S. Cl. ..... 451/44; 451/260; 451/289

[58] Field of Search ..... 451/44, 43, 260, 451/266, 285, 279, 289, 388, 276

[56] References Cited

U.S. PATENT DOCUMENTS

| | | | |
|---|---|---|---|
| 1,075,714 | 10/1913 | Hornig | 451/289 |
| 1,275,569 | 8/1918 | Hodny et al. | 451/289 |
| 1,489,317 | 4/1924 | Faulkner | 451/44 |
| 2,252,743 | 8/1941 | Wilkhaber | 451/239 |
| 3,458,959 | 8/1969 | Urbach | 451/289 |
| 4,227,347 | 10/1980 | Tam | 451/388 |
| 4,426,811 | 1/1984 | Eckardt | 451/44 |
| 4,597,228 | 7/1986 | Koyama | 451/289 |
| 5,117,590 | 6/1992 | Kudo | 451/285 |

FOREIGN PATENT DOCUMENTS

| | | | |
|---|---|---|---|
| 0257013 | 7/1988 | European Pat. Off. . | |
| 0162467 | 7/1987 | Japan . | |
| 0134166 | 6/1988 | Japan . | |
| 835244 | 5/1960 | Switzerland . | |
| 2236970 | 4/1991 | United Kingdom | 451/44 |

*Primary Examiner*—Robert A. Rose
*Attorney, Agent, or Firm*—Barnes & Thornburg

[57] ABSTRACT

An apparatus for chamfering the peripheral edge of a semiconductor wafer to specular finish, consisting of a turn table with an abrasive table surface, and a wafer holder, which holds the wafer firmly by sucking one face of the wafer, turn the wafer circumferentially, and press the wafer edge against the abrasive table surface in a manner such that the edge of the wafer is brought and kept in contact with the table surface in a way such that the triangle formed by the center of the turn table surface, the center of the wafer and said contact point is normal to the turn table surface and the angle formed between the turn table surface and the wafer is at the beginning substantially close to 0° but said angle is continuously or stepwise increased to a value substantially close to 180°, and the wafer holder also moves the wafer in a way such that the contact point is moved on the turn table surface.

11 Claims, 6 Drawing Sheets

APPARATUS AND METHOD FOR CHAMFERING THE PERIPHERAL EDGE OF A WAFER TO SPECULAR FINISH

This application is a continuation of application Ser. No. 07/888,097 filed May 26, 1992, now abandoned.

BACKGROUND OF THE INVENTION

The present invention relates to an apparatus for chamfering the peripheral edge of a semiconductor wafer in the thickness direction to specular (mirror) finish.

DESCRIPTION OF THE PRIOR ART

A semiconductor wafer to be made into substrates for semiconductor electronic devices is produced in the following manner: a single crystal ingot having an orientation flat of a semiconductor material such as silicon is sliced into thin plates by cutting it in a direction substantially normal to the axis of the ingot; then, the peripheral edge of each thin plate is chamfered both in the directions of circumference and thickness, and the faces of the plates are lapped, etched, annealed and polished and eventually the plates are rendered thin round disks having a mirror face on one side of them.

Now, in chamfering a sliced semiconductor wafer throughout the entire peripheral edge in the thickness direction to render the wafer edge to have a profile characterized by obtuse corners, such as the one shown in FIG. 8, so as to render the edge difficult to chip, the recent tendency has been such that the peripheral edge being chamfered is polished to the extent that the chamfers have specular gloss.

This peripheral specular chamfering is conducted, for example, in the manner as shown in FIG. 7, wherein slurry (wet polishing powder), not shown, is applied to the peripheral part of the semiconductor wafer W, which is fixed on a wafer turn table 101 by vacuum suction and is turning circumferentially in the direction indicated by the curved arrow, together with the table 101; and a polish disk (also a turn table) 111, whose top face is covered with a polishing pad and also turning in the direction indicated by the curved arrow, is pressed against the running edge of the semiconductor wafer W. When the disk 111 is applied to the peripheral edge of the wafer W from different angles, it is possible to provide the peripheral edge of the semiconductor wafer W with more than one glossy chamfers. In such a case, the profile of the edge becomes like a part of a polygon, as shown in FIG. 8, for example, wherein chamfers a, b, c, d, and e are made.

In the conventional practice, a plural number of polish disks 111 are applied simultaneously from different angles onto the edge of the semiconductor wafer W, and the wafer W is turned upside down by a wafer turn-over means after one side of the edge is chamfered, with the view of conducting the polygonal chamfering more time-efficiently; for example, in the case of chamfering of FIG. 8, three polish disks 111 are prepared to polish the edge from different predetermined angles corresponding to the aimed chamfers a, b and c and after these chamfers are finished, the wafer W is turned upside down, and the chamfers d and e are made in the same manner.

Problems the Invention seeks to solve

However, this conventionally practiced method necessitated the chamfering apparatus to be excessively complicated; and the polishing pad became unusable in a short time because of concentrated wear at the parts in contact with the wafer edge; and only polygonal chamfering was accomplished and it was not possible to chamfer the wafer edge in a manner such that the wafer edge would have a curved profile. Also, in the conventional practice, since both faces of the wafer had to be sucked firmly on the wafer table 101, the mirror face on which electronic circuits, etc. were laid was flawed and this resulted in degraded performance of the resulting electronic devices.

The present invention was made in view of these problems, and it is, therefore, an object of the invention to provide a simply and compactly constructed apparatus for chamfering the peripheral edge of the semiconductor wafer to specular finish, which is capable of chamfering the wafer edge to a specular finish in a manner such that the profile of the wafer edge is rounded, that it is not necessary to suck both faces of the wafer during the chamfering, and that the service life of the polishing pad is substantially extended.

Means to solve the Problems

In order to attain the object of the invention, there is provided an apparatus for chamfering the peripheral edge of a wafer to specular finish, characterized by comprising (a) an abrasive turn table, whose flat top surface is covered with an abrasive layer, and (b) a wafer hold-and-rub means, which is adapted to hold the wafer firmly by sucking one face of the wafer, turn the wafer circumferentially, and press the wafer edge against the abrasive surface of the turn table in a manner such that the edge of the wafer is brought and kept in contact with the turn table surface in a way such that the angle formed between the turn table surface and the wafer is at the beginning substantially close to 0° and said angle is continuously or stepwise increased to a value substantially close to 180°.

Preferably, the wafer hold-and-rub means is further adapted to move the wafer in a way such that the point at which the wafer edge contacts the turn table surface (the contact point) is moved on the turn table surface, while said angle is being increased.

More preferably, the edge of the wafer is brought and kept in contact with the turn table surface in a way such that the triangle formed by the center of the turn table surface, the center of the wafer and said contact point stands normal to the turn table surface, and the contact point is moved in a radial direction of the turn table on the turn table surface, while said angle is being increased.

Effects

According to the invention, only the non-mirror face of the wafer is sucked by the wafer hold-and-rub means of the specular finish chamfering apparatus, and the wafer is turned circumferentially, and the wafer hold-and-rub means presses the wafer edge against the abrasive surface of the turn table in a manner such that one side of the edge is first rubbed against the turn table and then gradually or stepwise the wafer is swung about the contact point until the other side of the edge is rubbed against the turn table. As the result, both sides of the wafer edge are chamfered in one operation wherein only the non-mirror face of the wafer is sucked and the mirror face of the wafer is left untouched; therefore, the mirror face is not flawed, and it is possible to chamfer the wafer edge to let it have a curved profile or a polygonal profile (when the wafer is swung about the contact point continuously, the profile will be curved, and when swung stepwise, the profile will be polygonal). Also, when the contact point is moved as the wafer edge is chamfered, the working area of the abrasive layer of the turn table which is rubbed by the wafer edge is larger and hence the service life of the abrasive layer is longer.

Furthermore, since the specular finish chamfering apparatus of the invention has only one wafer hold-and-rub means, and does not require a separate wafer turnover device, it can be simply and compactly constructed.

These and other objects and many of the attendant advantages of this invention will be readily appreciated as the same becomes better understood by reference to the following detailed description when considered in connection with the accompanying drawing.

Embodiments

Next, an embodiment of the invention, which is considered the best mode, will be described with reference to the attached drawings.

Figure 1:
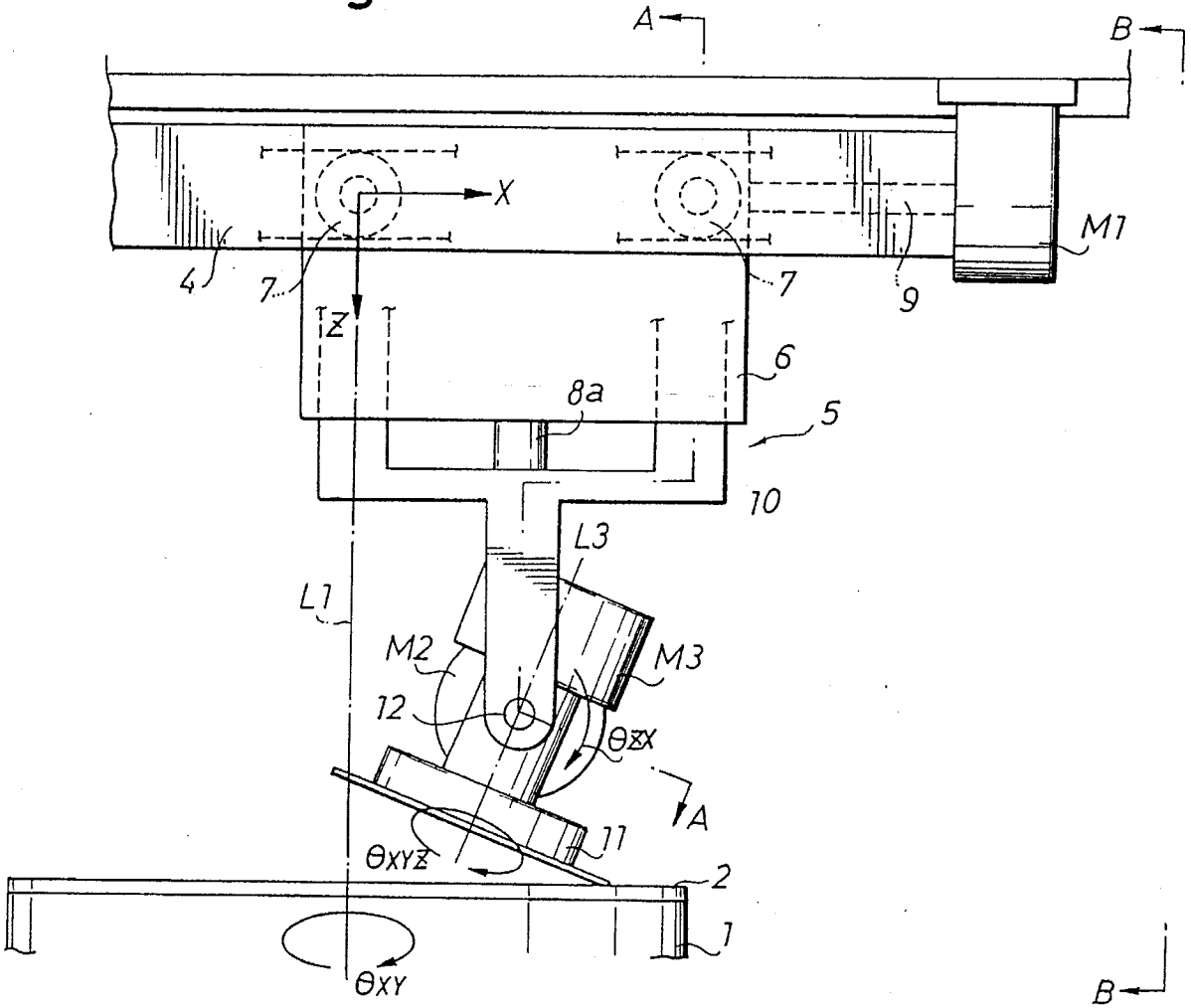
FIG. 1 is a side view of a specular finish chamfering apparatus of the invention.

In FIG. 1, which is a side view of a specular finish chamfering apparatus of the invention, the reference numeral 1 designates a rotary polish disk having a horizontal top flat surface entirely laid with a layer of a polishing pad 2, which 1 is driven to rotate about the central axis L1, which is parallel to the vertical axis Z, in a direction indicated by the round arrow $\theta_{XY}$.

Figure 2:
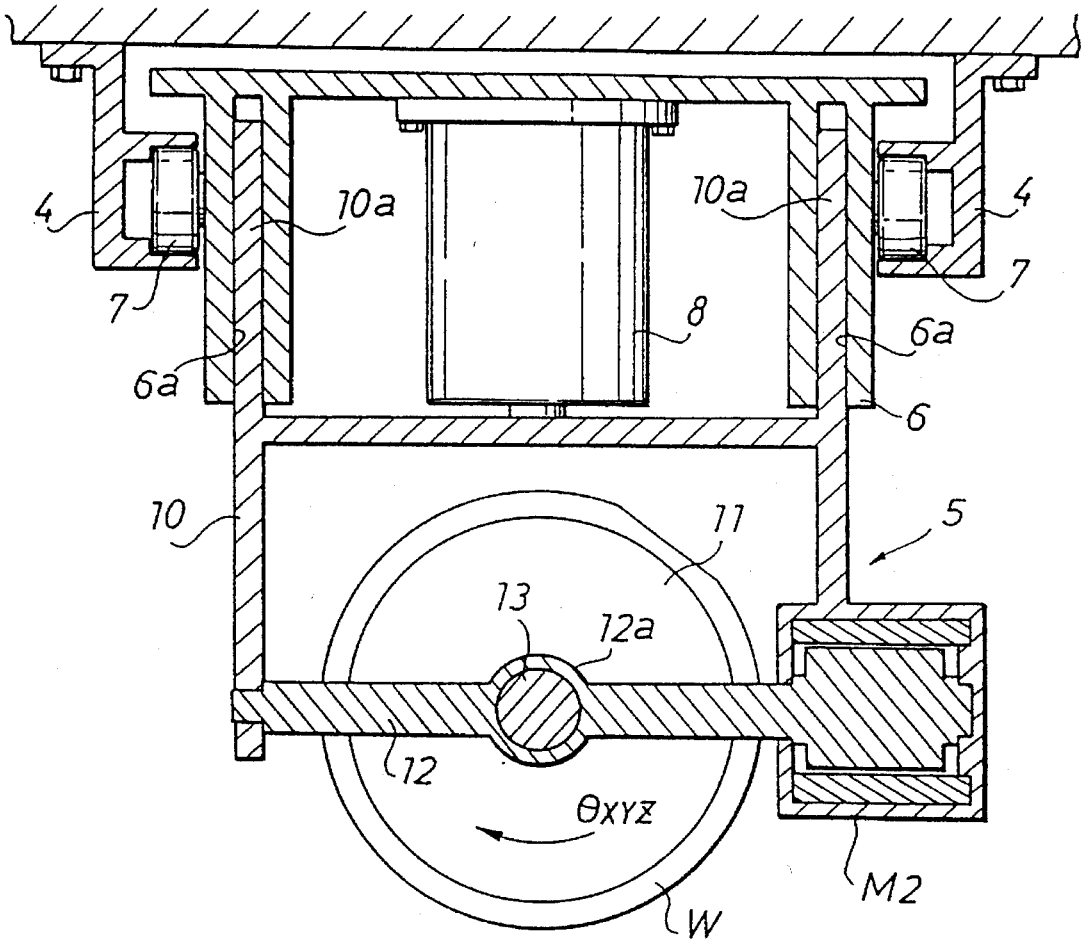
FIG. 2 is a cross-sectional view taken along section lines A13 A of FIG. 1.

A pair of parallel guide rails 4, 4 are horizontally passed right above the polish disk 1, and are fixed to the ceiling by means of bolts; and a wafer sucker unit 5 is supported by the guide rails 4 in a manner such that the unit 5 is freely shiftable along the axis X guided by the guide rails 4. A frame body 6 of the sucker unit 5 which 6 is shaped like a channel opening downwardly, is provided externally with four rollers 7, two on one side plate and two on the other and two on the front and two on the rear, as shown in FIGS. 1 and 2. These four rollers 7 are received laterally in the guide rails 4 in a manner such that they freely roll in the guide rails 4. An air cylinder 8 is fixed to the center portion of the ceiling of the frame body 6 in a manner such that the plunger rod 8*a* of the air cylinder 8 reciprocates vertically. A drive motor M1 is fixed to the ceiling by means of bolts at a location a little to the front of the middle point between the front ends of the rails 4, and the fore end of the horizontal ball screw shaft 9 extending from and turned by the drive motor M1 is threadably engaged with the front of the frame body 6 so that the sucker unit 5 is caused to shift to and fro along the guide rails 4, that is, in the direction of axis X.

Fixed at the lower end of the rod 8*a* extending downward from the air cylinder 8 is a support frame 10, which is a part of the sucker unit 5. Upper vertical laminar parts 10*a* of the support frame 10 are each slidably received in vertical guide slits 6*a* formed in the side plates of the frame body 6, as shown in FIG. 2, throughout the entire length of the frame body 6. Thus, as the rod 8*a* is driven by the air cylinder 8 to issue out or draw back, the support frame 10 is shifted vertically, that is, in the direction of axis Z, guided by the slits 6*a* of the frame body 6.

Figure 3:
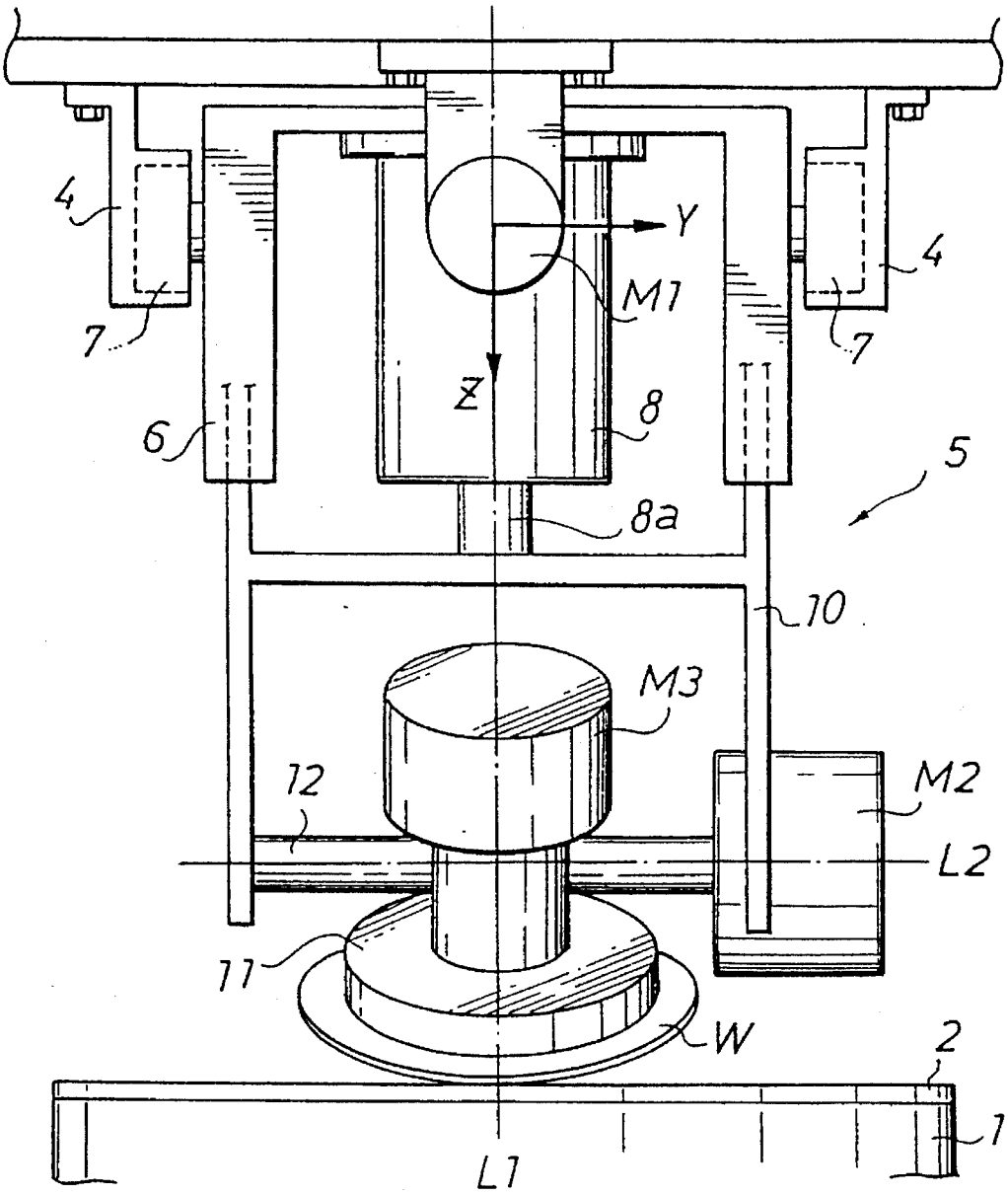
FIG. 3 is a front view of the same apparatus seen in the direction indicated by the arrows B of FIG. 1.

A wafer sucking assembly, composed mainly of a drive motor M3, a sucking disk 11 and a rotation shaft 13, is supported by the support frame 10 in a manner such that the wafer sucking assembly is rotatable about an axis L2, which intersects orthogonally the center line L3 of the wafer sucking assembly, and, when projected on the sheet of FIG. 3, intersects orthogonally the axis L1, and also such that the sucking disk 11 is rotatable about the center line L3. More particularly, the wafer sucking assembly is supported by a rotation shaft 12, which is held between the lower portions of the support frame 10 in a manner such that the center line of the shaft 12 coincides with the axis L2, and is in parallel with the axis Y, so that when the rotation shaft 12 turns about its center line, driven by a servomotor M2, the wafer sucking assembly is turned (tilted) simultaneously with the shaft 12 about the axis L2 in an angular direction $\theta_{ZX}$ through a desired angle. Also, as shown in FIG. 2, a rotation shaft 13 is rotatively passed through the central boss 12*a* of the rotation shaft 12, and the sucking disk 11 is fixed at the end of the rotation shaft 13. Thus, when the shaft 13 is driven to rotate by the drive motor M3, the sucking disk 11 is turned about the axis L3 in an angular direction of $\theta_{XYZ}$. Incidentally, the wafer sucking assembly is equipped with a sucking means, not shown, for producing a partial vacuum to thereby pick and firmly hold a wafer W on the sucking disk 11.

Next will be explained the wafer chamfering operation of the specular finish chamfering apparatus of the invention, with reference to FIG. 4.

Figure 4:
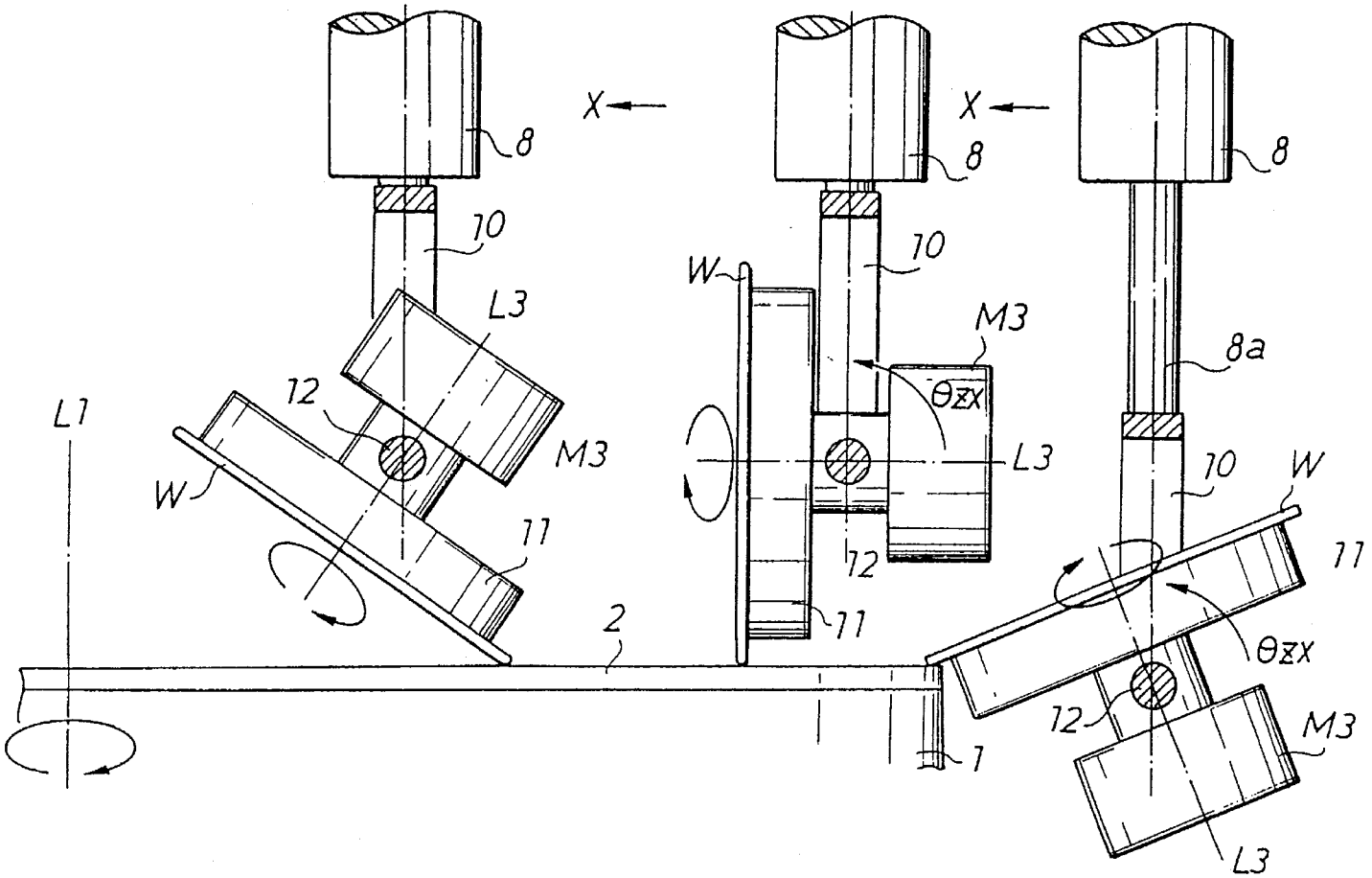
FIG. 4 is a drawing showing the operation of the specular finishing chamfering apparatus of the invention.

First, a wafer W is sucked and held firmly on the sucking disk 11 by means of the sucking means, not shown, the non-mirror face of the wafer W being in contact with the sucking disk 11; and the motor M1 and the air cylinder 8 are simultaneously caused to operate in a manner such that the sucker unit 5 is shifted in the direction of axis X along the rails 4 and lowered until the sucker unit 5 is positioned radially external to the polish disk 1, and at the same time the servomotor M2 is driven to turn the wafer sucking assembly about the axis L2 till the mirror face of the wafer W looks substantially upward, as shown at the right portion of FIG. 4. Then, the motor M1, the air cylinder 8, the servomotor M2 and the drive motor M3 cooperate to operate in a manner such that, first, the sucking disk 11 and the wafer W held thereby are turned about axis L3, and then, while the slurry is being supplied on the polishing pad 2, the non-mirror side of the peripheral edge of the wafer W is pressed on the polishing pad 2 of the polish disk 1 being driven to turn about the axis L1 by means of the drive means, not shown, at a place near the pheriphery of the polishing pad 2, with a predetermined pressure, as shown at the right portion of FIG. 4.

Now, the pressure with which the wafer W is pressed on the polishing pad 2 is determined by the following calculation.

Figure 5:
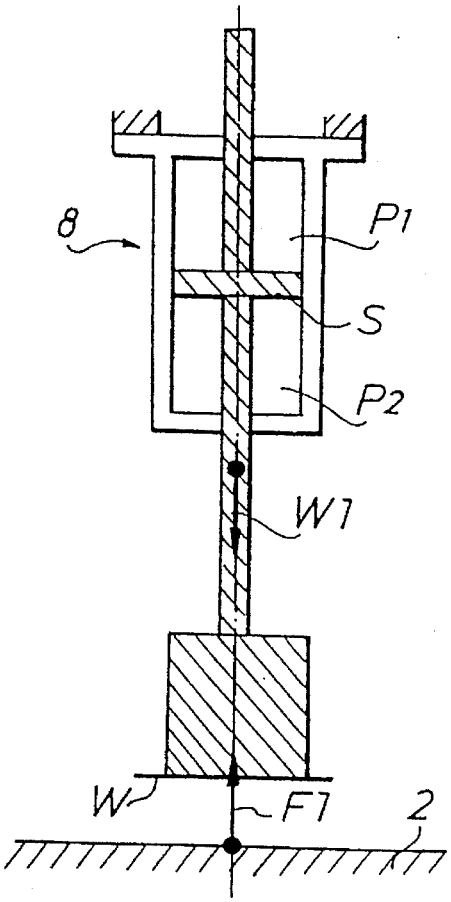
FIG. 5 is a drawing useful in explaining how the pressure applied on a wafer is calculated.

With reference to FIG. 5, let the pressure in the upper room of the air cylinder 8 be $P_1$, the pressure in the lower room of same be $P_2$, the pressure receiving area of the piston be S, the self weight of the piston system be $W_1$, and the reaction force that the wafer W receives from the polishing pad 2 be $F_1$; then, the following equation is obtained from the consideration of the balance of forces:

$$F_1-W_1=S(P_1-P_2) \quad (1)$$

or $$F_1=W_1+S(P_1-P_2) \quad (2).$$

Since the pressure with which the wafer W is pressed against the polishing pad 2 is equal to the scalar value of the reaction force $F_1$ which the wafer W receives from the polishing pad 2, the operator should control the values of $P_1$ and $P_2$ in a manner such that the said pressure is equaled by the value $F_1$ of Equation (2).

Now, returning to the operation, the drive motor M1, the air cylinder 8 and the servomotor M2 are caused to operate in a manner such that the sucker unit 5 is shifted in the direction indicated by the arrow X in FIG. 4, such that the wafer sucking assembly is continuously turned about the rotation shaft 12 in the angular direction $\theta_{ZX}$, and consequently such that the wafer W is turned counterclockwise, as seen in FIG. 4, with its sliding edge functioning as the fulcrum at which the wafer W is in sliding contact with the polishing pad 2, while the wafer W is kept pressed against the polishing pad 2 with the constant appropriate pressure, until the mirror side of the peripheral edge of the wafer W is pressed on the polishing pad 2 of the polish disk 1.

Figure 6:
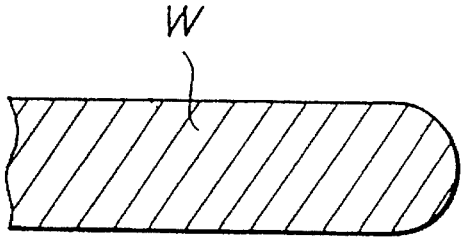
FIG. 6 is a cross section of a portion of a wafer showing the profile of the wafer edge which has been chamfered by means of the specular finish chamfering apparatus of the invention.
Figure 7:
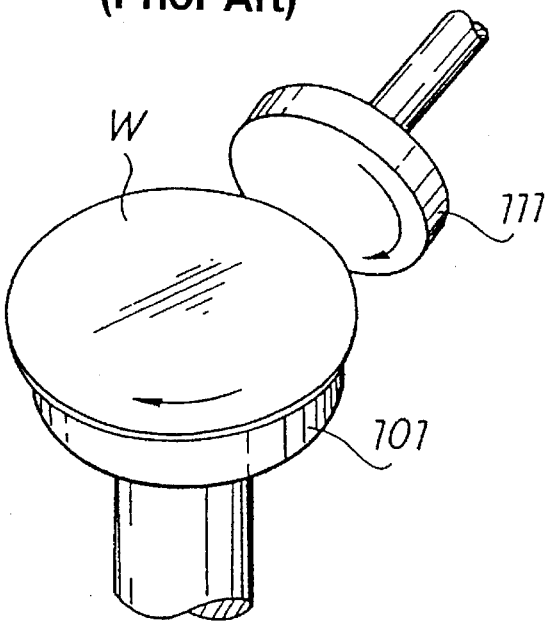
Fig . 7 (Prior Art)
FIG. 7 is a perspective view of a portion of a conventional chamfering apparatus used in explaining how a wafer edge is chamfered.
Figure 8:
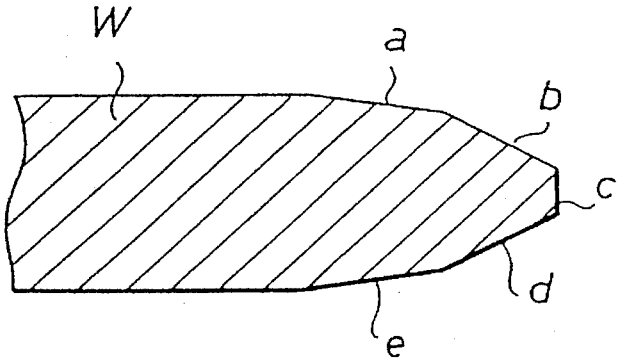
Fig . 8 (Prior Art)
FIG. 8 is a cross section of a portion of a wafer showing the profile of the wafer edge which has been chamfered in accordance with a conventional method.

Thus, when the edge of the wafer W is chamfered in the manner described above, it is possible to chamfer both sides of the edge to specular finish without having to have both faces of the wafer W sucked by the sucker unit 5. Also, since the wafer W is turned upside down continuously on the polishing pad 2 pasted on the large-diameter polish disk 1, it is now possible to chamfer the wafer edge in a manner such that the wafer edge will have a curved (round) profile, such as the one shown in FIG. 6. Furthermore, since the wafer edge is slided on the polishing pad 2 across a wider range, the wear of the polishing pad 2 is not locally concentrated and the pad 2 can retain its abrasiveness for an extended period of time, so that its service life is now longer. Incidentally, the non-mirror face of the wafer W, which is sucked and flawed by the sucker unit 5, is later subjected to a treatment such as to eliminate the flaw from the surface.

Also, the specular finish chamfering apparatus of the present invention has only a single sucking disk 11 and has no need of a separate means to turn over a wafer W, since the sucker unit 5 does the work; therefore, the apparatus of the present invention can be simply and compactly constructed.

Result of the Invention

As is clear from the above embodiment of the invention, a specular finish chamfering apparatus is provided which comprises (a) a polish disk 1, whose flat top surface is formed with an abrasive layer, and (b) a wafer sucker unit 5, which holds the wafer W firmly by sucking the non-mirror face of the wafer, turns the wafer circumferentially, and presses the wafer edge against the abrasive surface of the polish disk 1 in a manner such that the edge of the wafer is brought and kept in contact with the polish disk surface in a way such that: the triangle formed by the center of the polish disk surface, the center of the wafer and the contact point stands normal to the polish disk surface; such that the angle formed between the polish disk surface and the wafer is at the beginning substantially close to 0° but is continuously or stepwise increased to a value substantially close to 180°; and such that the contact point is moved in a radial direction of the turn table on the turn table surface, while said angle is being increased.

As the result, one side of the wafer edge is first rubbed against the polish disk and then gradually or stepwise the wafer is swung about the contact point until the other side of the edge is rubbed against the polish disk, so that both sides of the wafer edge are chamfered in one operation while the mirror face of the wafer is not sucked and flawed, and it is also possible to chamfer the wafer edge to let it have a curved profile or a polygonal profile. Also, since the contact point is moved as the wafer edge is chamfered, the working area of the abrasive layer of the polish disk which is rubbed by the wafer edge is larger and hence the service life of the abrasive layer is longer.

Furthermore, since the specular finish chamfering apparatus of the invention has only one wafer sucker unit 5, and does not have to have a separate wafer turnover device, it can be simply and compactly constructed.

While the invention has been described in its preferred embodiment, it is to be understood that modifications will occur to those skilled in that art without departing from the spirit of the invention. The scope of the invention is therefore to be determined solely by the appended claims.

What is claimed is:

1. A method for chamfering the peripheral edge of a wafer, which comprises:

providing a wafer having two opposed surfaces;

providing a turn table having an abrasive surface;

providing a wafer hold-and-rub means; and holding one of said two opposed surfaces of said wafer firmly by said wafer hold-and-rub means so as to support said wafer while:

moving said hold-and-rub means so that said one surface of said wafer which is held firmly by said hold-and-rub means is brought in contact with said abrasive surface and said wafer is pivoted while remaining in contact with said abrasive surface such that said two opposed surfaces of said wafer are each chamfered; and turning said wafer circumferentially.

2. A method for chamfering the peripheral edge of a wafer according to claim 1, wherein an angle defined between said abrasive surface and said wafer is changed from about 0° to about 180° as said wafer is pivoted.

3. A method for chamfering the peripheral edge of a wafer according to claim 1, wherein another of said two opposed surfaces of said wafer which is opposite said one surface which is held firmly by said hold-and-rub means comprises a mirror surface.

4. A method for chamfering the peripheral edge of a wafer according to claim 1, wherein said abrasive surface is flat.

5. A method for chamfering the peripheral edge of a wafer according to claim 1, wherein said wafer is moved across said abrasive surface while remaining in contact with said abrasive surface and being pivoted.

6. A method for chamfering the peripheral edge of a wafer according to claim 5, wherein said wafer is moved across said abrasive surface in a radial direction of said abrasive surface.

7. A method for chamfering the peripheral edge of a wafer according to claim 1, wherein a triangle defined between a center of said wafer, a center of said abrasive surface, and a contact point between said wafer and said abrasive surface is always normal to said abrasive surface.

8. An apparatus for chamfering the peripheral edge of a wafer to a specular finish which comprises:

an abrasive turn table having a flat abrasive surface;

a carrier means which is movable along a direction toward and away from said flat abrasive surface;

an air cylinder connected to said carrier means, said air cylinder including a piston having a rod attached thereto;

a frame body connected to a portion of said rod which extends from said air cylinder, said frame body including a rotatable shaft which is orthogonal to said direction in which said carrier means moves; and a wafer hold-and-rub means connected to said rotatable shaft for pivotal movement therewith, said wafer hold-and-rub means being adapted to hold a wafer firmly by applying a suction force to one surface thereof and turn the wafer circumferentially.

9. An apparatus for chamfering the peripheral edge of a wafer to a specular finish according to claim 8, wherein said piston divides said air chamber into two chambers in which fluid pressure is controlled so that the difference in fluid pressure in each of said two chambers is maintained constant irrespective of the position of said piston.

10. An apparatus for chamfering opposite sides of a wafer which comprises:

an abrasive turn table having a flat abrasive surface and a peripheral side;

a wafer hold-and-rub means including a rotatable suction disk for holding a wafer firmly thereto by applying a suction force to one surface of the wafer and for turning the wafer circumferentially; and means for moving said suction disk across said flat abrasive surface and for pivoting said suction disk over said peripheral side of said abrasive turn table, whereby a surface of a wafer which is held by said suction disk is brought in contact with said abrasive surface and the wafer is pivoted together with said suction disk while remaining in contact with said abrasive surface such that opposite surfaces of the wafer are each chamfered.

11. An apparatus for chamfering opposite sides of a wafer according to claim 10, wherein said means for moving said suction disk comprises means for moving said suction disk across said flat abrasive surface in a radial direction of said flat abrasive surface.

* * * * *